United States Patent [19]

Mihovch et al.

[11] 4,408,553

[45] Oct. 11, 1983

[54] LOW TORQUE DIRECT DIALING PATTERN SELECTION MECHANISM

[75] Inventors: John Mihovch, Keansburg; John Blackwood, Union, both of N.J.

[73] Assignee: The Singer Company, Stamford, Conn.

[21] Appl. No.: 221,177

[22] Filed: Dec. 29, 1980

[51] Int. Cl.[3] ..... D05B 3/02

[52] U.S. Cl. ..... 112/158 A

[58] Field of Search ..... 112/158 A, 158 D

[56] References Cited

U.S. PATENT DOCUMENTS 3,753,411 8/1973 Graham et al. ..... 112/158 A
3,766,871 10/1973 Mastuda et al. ..... 112/158 A
3,786,769 1/1974 Coulombe ..... 112/158 A
4,313,389 2/1982 Hanyu et al. ..... 112/158 A

*Primary Examiner*—Werner H. Schroeder
*Assistant Examiner*—Andrew M. Falik
*Attorney, Agent, or Firm*—David L. Davis; Robert E. Smith; Edward L. Bell

[57] ABSTRACT

A low torque direct dialing pattern selection mechanism for a sewing machine having an operator actuatable control dial. Initial rotation of the dial effects an isolation of the cam follower mechanism from the cam influenced stitch forming instrumentalities. Continued rotation of the control dial causes selective positioning of a pattern cam follower for operational engagement with a desired pattern cam.

6 Claims, 4 Drawing Figures

LOW TORQUE DIRECT DIALING PATTERN SELECTION MECHANISM

DESCRIPTION

BACKGROUND OF THE INVENTION

This invention relates to pattern cam selection devices for sewing machines of the type wherein the cam follower is moved toward or away from the cam for engagement or disengagement therewith.

These mechanisms typically utilize a movable bracket to which the cam follower is pivotally attached. The bracket is arranged so that the operator may effect movement thereof by manipulating a control mechanism. When engaging the follower, the bracket is moved so that the pivotal axis of the cam follower moves toward the pattern cam and causes one extremity of the follower to contact the cam surface and the other extremity to contact a connecting rod or bar associated with a stitch forming instrumentality of the sewing machine. Devices of this nature are disclosed in U.S. Pat. No. 3,332,380, Jul. 25, 1967, Keizo and U.S. Pat. No. 3,339,508, Sept. 5, 1967, Keizo, the teachings of which are incorporated herein by reference.

Other mechanisms utilize a movable surface which abuts a smoothly curved portion of the cam follower in such a way that the follower, when actuated by the cam, will rock on the movable surface, similar to the operation of a fulcrum. When disengaging the follower from the cam, the movable surface is simply moved away from the curved surface allowing a spring to retract the follower. An example of this construction is disclosed in U.S. Pat. No. 3,041,988, Jul. 3, 1962, Fujita, the teachings of which are incorporated herein by reference.

These constructions have the disadvantage that when moving the cam follower into engagement with a high lobe on the cam, the connecting rod or bar associated with a stitch forming instrumentality must be moved to its extreme position relative to the high lobe of the cam simultaneously with the follower being positioned into engagement with the cam. Therefore, in addition to the normal forces required for actuating the mechanism to engage the follower, there are the additional forces required to move the stitch forming instrumentality, such as a needle bar, to one of its extreme positions against a spring biasing force. These two forces when taken together can be significant and can render the manual actuation of such a cam selection device difficult.

A somewhat different construction utilizes a manually rotatable dial having two interrelated cam surfaces. As the dial is rotated, the first cam surface effects disengagment of the cam followers from the needle bar and feed control cams. Continuing rotation of the dial causes the second cam surface to effect indexing of the followers to the next cam position, whereupon the first cam surface effects engagement of the followers and newly selected cams. For each movement of the followers to a newly indexed position, the followers must first be retracted, indexed to the next position, then reengaged again. If it is desired to select a pattern cam which is several indexing positions away from the present follower position, the followers must be retracted and then reengaged for each position moved.

The present invention overcomes these disadvantages through the use of a novel but simple mechanism.

SUMMARY OF THE INVENTION

It is an object of this invention to provide a pattern cam selection mechanism which requires a reduced amount of manually applied force to operate.

It is another object of this invention to provide a pattern cam selection mechanism wherein the cam follower is temporarily isolated from the cam influenced stitch forming mechanism prior to operationally engaging the pattern cam.

It is another object of this invention to provide a pattern cam selection mechanism having an operator actuated cam selecting dial wherein the dial has two separate zones of influence, one of which is limited to engaging and disengaging the cam follower and pattern cam.

Other objects and advantages of the invention will become apparent through reference to the accompanying drawings and descriptive matter which illustrates a preferred embodiment of the invention.

According to the present invention, there is provided a sewing machine having sewing instrumentalities at least one of which partakes of vibratory motion in the formation of lockstitches. A plurality of information cams is provided having movement in timed relation to the sewing instrumentalities and at least one cam follower arranged for operational engagement with and movement by the information cams. Coupling means is arranged between the cam follower and at least one stitch forming instrumentality for imparting vibratory motion to the sewing instrumentalities in response to the movement of the cam follower. Selection means is provided including an operator influencable element supported for one continuous operational movement. A first means driven by the operator influenced element is included for effecting a first mode of operation rendering the coupling means selectively effective or ineffective. A second means driven by the operator influenced element is included for effecting a second mode of operation selectively positioning the cam follower into or out of operational engagement with one of the plurality of information cams. A lost motion connection is provided between the operator influenced element and the second means, the first means being driven only during lost motion provided by the lost motion connection and the second means being operative only after the lost motion provided by the lost motion connection is completed.

BRIEF DESCRIPTION OF THE DRAWINGS

In order that the invention be more fully understood, it will be described by way of example with reference to the accompanying drawings in which.

DESCRIPTION OF THE PREFERRED EMBODIMENT

Figure 1:
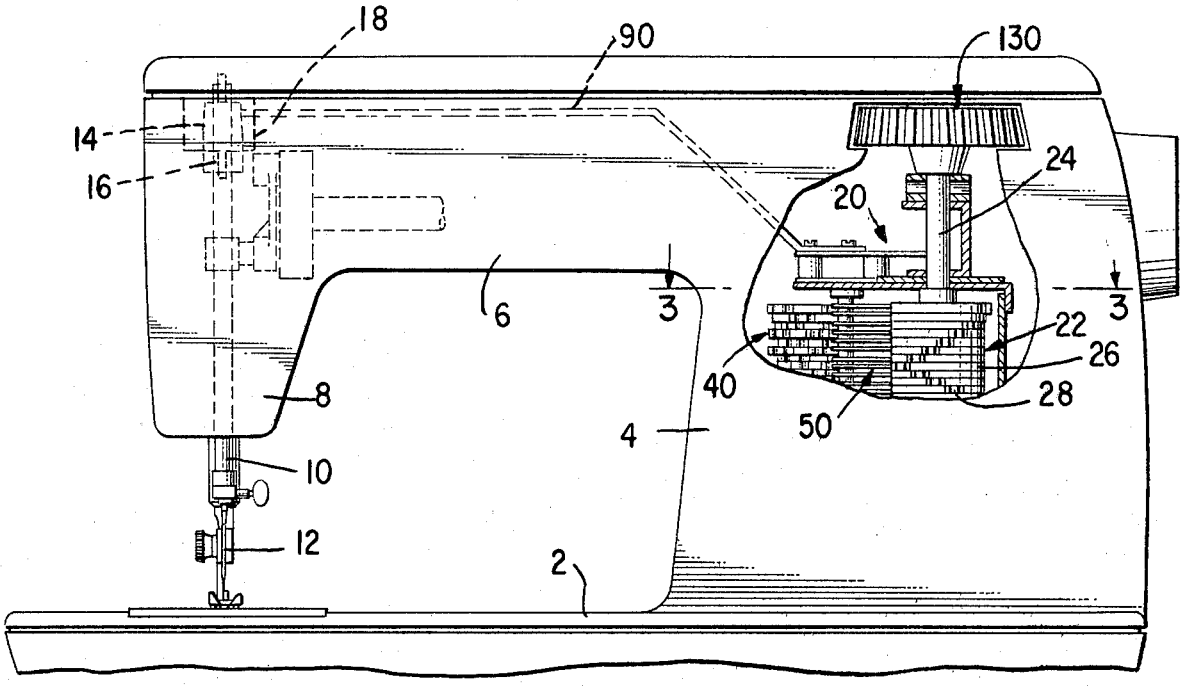
FIG. 1 is a front view of a sewing machine showing a preferred embodiment of the present invention.
Figure 2:
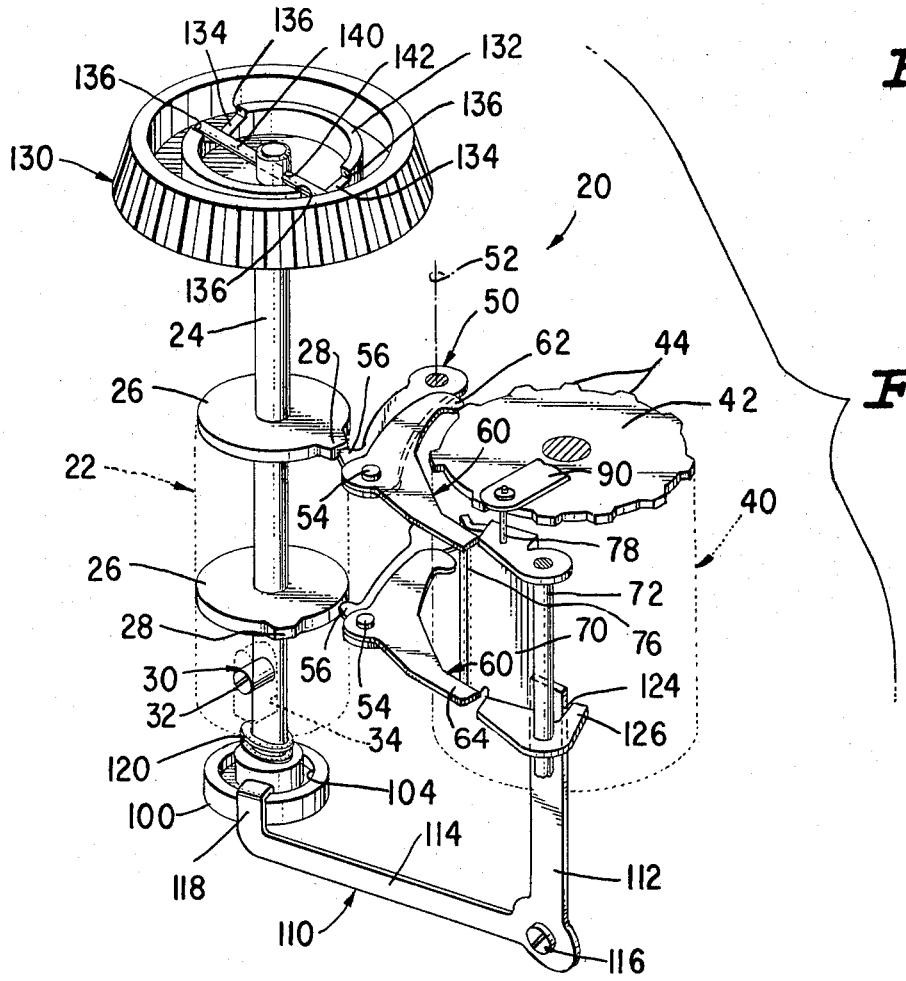
FIG. 2 is a partial perspective view showing selected components of the present invention.
Figure 3:
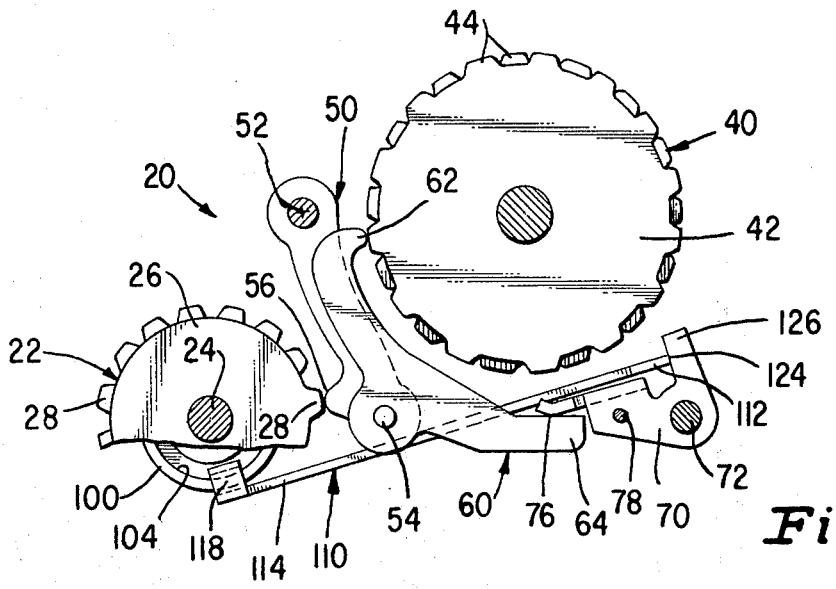
FIG. 3 is a plan view of the mechanism shown in FIG. 2.
Figure 4:
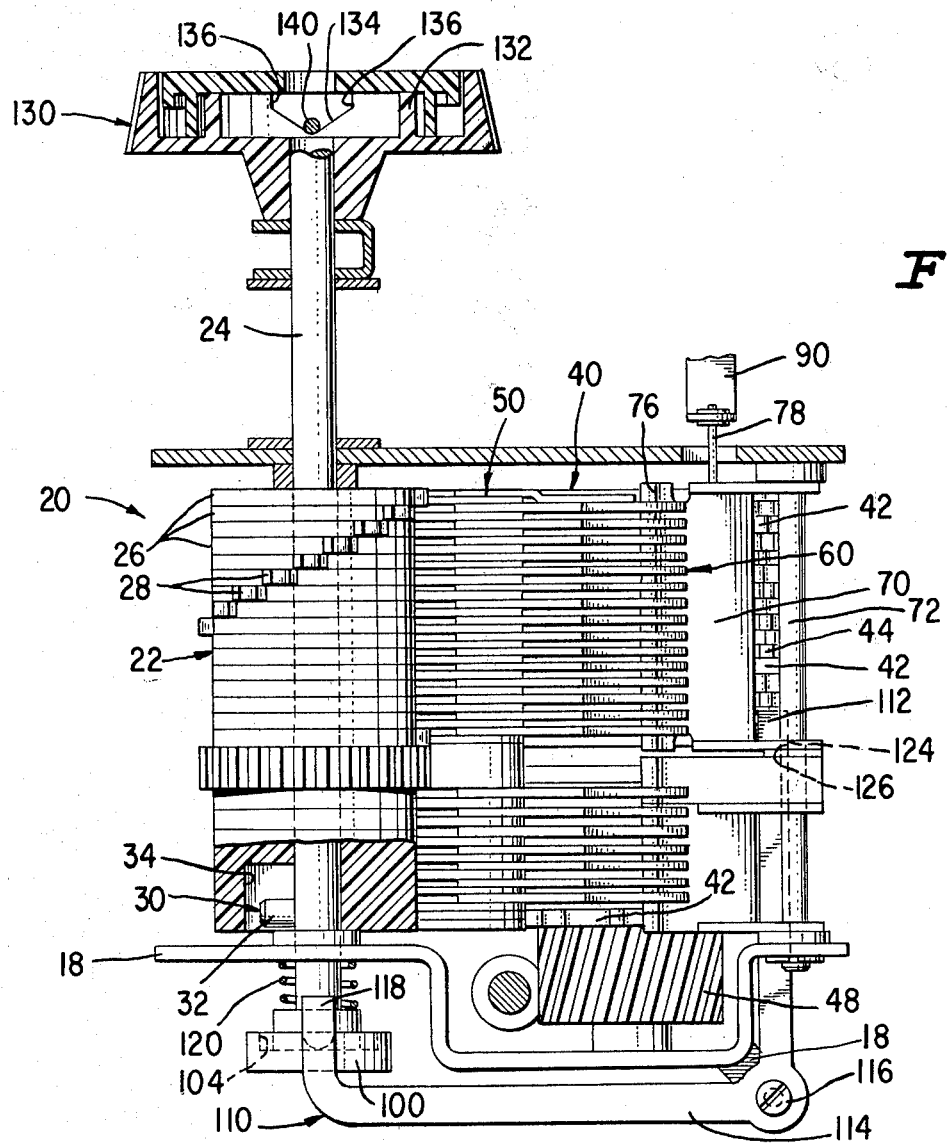
FIG. 4 is a front view of the mechanism shown in FIG. 3.

Referring to FIGS. 1–4, there is shown a sewing machine having a bed 2, a standard 4, an arm 6 and a sewing head 8, the sewing head having mounted therein a needle bar 10 and thread carrying needle 12. The needle bar 10 is mounted for reciprocating motion in a needle bar gate 14 which is pivotally attached at 16 to the machine frame 18 as best seen in FIG. 1.

A pattern cam selection mechanism is shown generally at 20 in FIG. 1 and includes a selection cam stack or drum 22 having a coaxial shaft 24 therethrough, a pattern cam stack 40 driven by the sewing machine arm shaft through gear 48, an array of followers 50 and 60, a linkage mechanism for disengaging the drive link 90 from the pattern cam followers, and an operator actuatable dial for effecting cam selection.

The selection cam stack 22 contains a plurality of individual selection cams 26, each of which has at least one high lobe 28. The shaft 24 is journalled for rotation in the frame 18 of the machine. The selection cam stack is keyed to the shaft 24 at 30 wherein a dog-point set screw 32, or similar fastener, is threaded into the cam stack hub so that the point of the set screw 32 loosely engages a slot 34 which is formed in the shaft 24, permitting axial movement of the shaft 24 with respect to the cam stack 22. The cam stack 22, however, is constrained from moving axially with respect to the frame of the sewing machine. The pattern cam stack 40 consisting of a plurality of individual pattern cams 42, each of which has at least one high lobe 44, is journalled for rotation in the frame of the sewing machine and driven by the sewing machine arm shaft. There are a plurality of selection cam followers 50 pivotally mounted along a common pivotal axis 52 at one extremity thereof and a mounting pin 54 rigidly attached to the other extremity. Near the extremity having the mounting pin 54 there is formed therein a cam engaging portion 56 for operationally engaging the selection cam 26. A pattern cam follower 60 having a cam engaging portion 62 formed at one extremity thereof and a tail portion 64 formed at the other extremity is arranged for pivotal movement about mounting pin 54. The cam engagement portion 62 is arranged for operational engagement with the pattern cam 42. For every pattern cam 42, there is a corresponding selection cam 26, selection cam follower 50 and a pattern cam follower 60. A wobble plate 70 is pivotally mounted on shaft 72 which is arranged parallel to the axis of the pattern cam stack. The wobble plate 70 has an abutting portion 76 which abuts the tail portions 64 of the pattern cam followers 60. One extremity of a drive link 90 is pivotally coupled to the wobble plate 70 by a pin 78 or some other suitable device. The other extremity of the drive link 90 is pivotally attached to the needle bar gate 14 for imparting jogging motion thereto. Thus, as the pattern cam stack rotates, a selected pattern cam 42 will engage the cam engaging portion 62 of a specific pattern cam follower 60 imparting rocking motion thereto. The tail portions 64 will then impart this rocking motion to the wobble plate 70 for transmission to the needle bar gate via the drive link 90 as needle jogging motion.

A desired pattern cam is selected by simply rotating the shaft 24 until the high lobe 28 of the appropriate selection cam 26 engages the cam engaging portion 56 of the appropriate selection cam follower 50 thereby engaging the pattern cam follower 60 with the desired pattern cam 42.

A collar 100 having an annular groove 104 formed in its upper surface is rigidly attached to the lower extremity of the shaft 24. An L shaped arm 110 having a vertical arm 112 and a horizontal arm 114 is pivotally mounted to the frame 18 at 116. The free extremity of the horizontal arm 114 has formed therein a U shaped end 118 which is arranged for operational engagement with the annular groove 104 of the collar 100. There is a spring 120 arranged for biasing the horizontal arm 114 in the downward direction so as to impart a counterclockwise bias to the L shaped arm 110 as viewed in FIG. 2. This imparts a downward pull on the shaft 24. The upper extremity 124 of the vertical arm 112 is arranged to abut a tab 126 orthogonally formed in the wobble plate 70.

A manually actuatable dial 130 is attached loosely to the upper extremity of the shaft 24 and is arranged for limited rotational movement relative thereto. A lifter cam comprising an axially formed ring having a face 132 is arranged within the dial 130 and has formed therein two V slots 134 which are diametrically opposed. The face 132 is arranged parallel to a plane defined by the rotational movement of the dial 130. The two V slots each have two shoulder portions 136. A pin 140 which is attached to the upper extremity of the shaft 24 at 142 is arranged so that its two extremities engage the V slots 134 of the ring 132. The shoulder portions 136 of the V slots 134 limits the movement permitted of the pin 140 relative to the dial 130. Thus, the dial 130 may be freely rotated on the shaft 24 within the allowable limits of the shoulder portions 136. Because the dial 130 is constrained from moving downward under the biasing pull of the spring 120, the dial will align itself so that the pin 140 rests in the bottom of the two V slots 134. As the dial is rotated, the pin 140 will cam upwardly along the surface of the V slots 134 thus causing the shaft 24 to move upwardly with respect to the selection cam stack 22 thus causing the collar 100 to move upwardly. The L shaped arm 110, having its U shaped end 118 in engagement with the annular slot 104, is caused to rotate clockwise about the pivot point 116 in opposition to the biasing force of the spring 120. As the L shaped arm 110 pivots clockwise, the end portion 124 of the vertical arm 112 presses against the tab 126 causing the wobble plate 70 to pivot such that it disengages with the tail portions 64 of the pattern cam followers 60. In doing so, the wobble plate causes the drive link 90 to jog the needle bar gate to its furthest excursion. This action decouples the needle jogging mechanism from the pattern cam followers prior to cam selection. At this point, the pin 140 has engaged the shoulder portions 136, and upward motion of the shaft 24 ceases. Continued rotation of the dial 130 then causes the shaft 24 to rotate and the selection cam stack or drum 22 to rotate therewith. As a high lobe 28 of one of the selection cams 26 moves into engagement with the cam engaging portion 56 of the corresponding selection cam follower 50, the pattern cam follower 60 that is associated therewith is moved into position for operational engagement with its corresponding pattern cam 42 free of interference with a high lobe 44 of the pattern cam. As rotation of the dial 130 continues, the high lobe 28 moves out of engagement with the cam engaging portion 56 permitting the selection cam follower 50 to pivot away from the pattern cam stack thus moving the pattern cam follower 60 out of position for operational engagement with the pattern cam 42. As rotation of the dial 130 continues, a high lobe 28 of another selection cam 26 comes into engagement with the cam engaging portion 56 of another selection cam follower, thereby moving another pattern cam follower into position for operational engagement with its associated pattern cam. This process continues until a follower is positioned for engagement with a desired pattern cam. At this point, rotation of the dial 130 ceases and the dial is allowed to freely rotate in the reverse direction sufficient to allow the pin 140 to move down into the V slots 134 under the biasing force of the spring 120. As this occurs, the vertical arm 112 pivots counterclockwise thereby recoupling the follower and the needle jogging mechanism. This completes the selection of a desired pattern cam. Once rotation of the dial 130 is initiated and the pin 140 rides up the V slots 134 and ultimately causes the wobble plate 70 to disengage from the tail portions 64 of the pattern cam followers 60, further rotation of the dial rotates the selection cam stack or drum 22 thereby selectively positioning the pattern cam followers 60 into or out of operational engagement with their respective pattern cams 42. As long as rotation of the dial 130 continues, in the same direction, the wobble plate 70 remains disengaged from the tail portions 64 and there is a one to one turning ratio between the dial 130 and the selection cam stack 22. In this way, as the dial is continuously turned, selective positioning of the pattern cam followers may occur seriative while the lost motion angular displacement of the dial needed to effect disengagement of the wobble plate occurs only once. Therefore, the selection cam stack 22 need not account for this lost motion angular displacement permitting it to accommodate more selectable positions in a given angular segment.

The dial 130 thus has two modes of operation. The first mode of operation being the rotation of the dial 130 while the pin 140 is moving up the surface of the V slots 134 and into engagement with the shoulder portions 136. The second mode of operation is from that point where the pin 140 engages the shoulder portions 136 through rotational movement of the shaft 24. Therefore, the dial 130 while in its first mode of operation is effective for disengaging the drive link which drives the needle bar gate from the pattern cam followers and while in its second mode of operation the dial 130 positions a desired pattern cam follower for operational engagement with a pattern cam. This has the effect of preventing the two forces, 1) needed to disengage the drive link 90 and needle bar gate 14 from the pattern cam followers and 2) needed to select a desired pattern cam follower, from being additive which would increase the instantaneous force required to rotate the dial 130.

The important feature of the present invention is that a single continuous motion of the operator will isolate the cam follower mechanism from the cam influenced stitch forming instrumentalities and then, without any change in the motion, will cause the selective positioning of a cam follower for operational engagement with a desired pattern cam. Thus, the operator motion needed for follower isolation occurs only once, even if the desired pattern cam is several cam positions away. Additionally, because this lost motion needed for follower isolation occurs only once in any given selection situation, a higher density of selectable positions may be provided in the selection cam stack resulting in less operator motion being needed to complete a particular selection.

While in the above description the drive link 90 was connected to a needle bar gate 14 for laterally jogging the needle bar 10, it is expressly understood that the drive link 90 may be connected to any stitch forming instrumentality that partakes of a vibratory motion in the formation of lockstitches. Further, continuous rotary motion was described for operation of the selection mechanism of the present invention, however, it should be understood that linear or arcuate motion may be utilized with minor changes in the construction and such constructions are considered to be within the spirit and scope of this invention.

Upon reviewing the present disclosure, a number of alternative constructions will occur to one skilled in the art. Such constructions may utilize various pin and V slot arrangements to effect the desired two modes of operation of the dial 130. Similarly, the L shaped arm 110 may be of varying shapes, the only requirement being that the vertical motion of the shaft 24 is transmitted to the tab 126 of the wobble plate 70. Such alternative constructions are considered to be within the spirit and scope of this disclosure.

I claim:

1. A sewing machine having stitch forming instrumentalities at least one of which partakes of vibratory motion in the formation of lockstitches, a. a plurality of information cams moving in timed relation to said stitch forming instrumentalities, b. a cam follower arranged for operational engagement with and movement by a selected one of said information cams, c. coupling means between said cam follower and said at least one stitch forming instrumentality effective for imparting said vibratory motion to said at least one stitch forming instrumentality in response to said movement of said cam follower, d. information cam selection means including an operator influencable element supported for one continuous operational movement, first means driven by said operator influencable element for effecting a first mode of operation rendering said coupling means ineffective, second means driven by said operator influencable element for effecting a second mode of operation to serially position said cam follower into operational engagement with said plurality of information cams one by one, a lost motion connection between said operator influencable element and said second means, said first means being driven only during the lost motion movement of said operator influencable element provided by said lost motion connection and said second means being operative only after completion of the lost motion movement of said operator influencable element provided by said lost motion connection, said first means remaining effective after completion of said lost motion movement while said second means is effective, said operator influencable element being biased so that upon the absence of operator influence thereon said operator influencable element partakes of lost motion movement to render inoperative said second means and to cause said first means to render effective said coupling means.

2. A sewing machine as set forth in claim 1 wherein said selection means further includes a drum having a substantially cylindrical shaped outer surface arranged for rotational movement about an axis, said drum having a protrusion arranged for influencing said cam follower to effect said operational engagement between said cam follower and said information cam.

3. A sewing machine as set forth in claim 1 wherein said first mode of operation comprises movement of said operator influencable element starting at its uninfluenced rest position and continuing for a first predetermined amount of operator influence whereupon with further operator influence said second mode of operation becomes effective and continues to be effective for a second predetermined amount of operator influence.

4. A sewing machine as set forth in claim 3 wherein said operator influencable element comprises a rotatable dial and wherein said first and second modes of operation comprise successive angular increments of turning movement of said dial in the same direction of rotation.

5. A sewing machine as set forth in claim 4 wherein said first means includes a cam surface comprising a V slot formed in a ring shaped surface of said dial, said ring shaped surface being parallel to a plane defined by said rotational movement of said dial.

6. A sewing machine having stitch forming instrumentalities at least one of which partakes of vibratory motion in the formation of lockstitches, a plurality of pattern cams moving in timed relation to said sewing instrumentalities, a cam follower positionable for operational engagement with and movement by a selected one of said plurality of pattern cams and out of operational engagement therewith, coupling means between said cam follower and said at least one stitch forming instrumentality effective for imparting said vibratory motion to said at least one stitch forming instrumentality in response to said movement of said cam follower, and selection means including:

a. an operator actuatable dial arranged for one continuous rotational movement, said movement being partitioned into first and second separate contiguous movements, b. a lifter cam comprising a ring arranged axially with respect to and forming a rigid part of said dial, said ring having two diametrically opposed V slots formed therein, and link means arranged in operational engagement with said V slots for rendering said coupling means selectively effective or ineffective only during said first movement of said dial, c. a follower enabling means for positioning said cam follower for operational engagement with said selected one of said pattern cams only during said second movement of said dial and only after said first movement of said dial is completed.

* * * * *